US005402099A

United States Patent [19]

Ballard et al.

[11] Patent Number: 5,402,099

[45] Date of Patent: Mar. 28, 1995

[54] HIGH TEMPERATURE, TEMPERATURE RESPONSIVE SNAP ACTING CONTROL MEMBER AND ELECTRICAL SWITCHES USING SUCH MEMBERS

[76] Inventors: Edwin C. Ballard, 26 Heritage Rd., Rehoboth, Mass. 02769; Andrew A. Amatruda, Jr., 384 S. Main St., Attleboro, Mass. 02703; Sheldon S. White, 46 Blake Rd., Brookline, Mass. 02146

[21] Appl. No.: 166,757

[22] Filed: Dec. 14, 1993

[51] Int. Cl.[6] ..... H01H 37/00

[52] U.S. Cl. ..... 337/298; 337/343

[58] Field of Search ..... 337/298, 365, 349, 343, 337/372, 373

[56] References Cited

U.S. PATENT DOCUMENTS

| | | | |
|---|---|---|---|
| 3,715,699 | 2/1973 | Hire | 337/348 |
| 4,492,946 | 1/1985 | Loescher | 337/365 |
| 5,107,235 | 4/1992 | Torres-Isea | 337/140 |

OTHER PUBLICATIONS

Thermostat Metals Designer's Guide Publisher: Texas Instruments Incorporated Published: 1991.

*Primary Examiner*—Lincoln Donovan

*Attorney, Agent, or Firm*—Russell E. Baumann; Richard L. Donaldson; René Grossman

[57] ABSTRACT

A snap acting control member (10, 10*b*) having high actuating temperatures comprises metal layers metallurgically bonded together with a low expansion (12) and a relatively high expansion layer (14) each having similar moduli of elasticity and the low expansion layer being formed of a precipitation hardenable stainless steel so that after forming into a dished shaped configuration to make the member snap acting the low expansion layer is heat treated to increase the strength. The control member can be used solely to sense temperature or it can be used as an electrical current carrying member. When used in the latter manner, the electrical resistivity of the member can be adjusted by interposing a selected layer (16) between layers (12) and (14) to thereby increase or decrease the resistivity of the member (10*b*) depending on the particular metal chosen for the interlayer. An electrical switch (24) is shown in which a snap acting member is used as a sensor and another electrical switch (48) is shown in which the snap acting member is a current carrying member.

18 Claims, 1 Drawing Sheet

HIGH TEMPERATURE, TEMPERATURE RESPONSIVE SNAP ACTING CONTROL MEMBER AND ELECTRICAL SWITCHES USING SUCH MEMBERS

BACKGROUND OF THE INVENTION

This invention relates generally to snap acting thermostatic disc members which are used for performing control functions and more particularly to thermally responsive snap acting members embodying iron alloy materials selected for strength and temperature resistance properties for use with electrical switches employing high temperature snap acting members.

A known type of thermally responsive control member used for performing control functions has a dished shaped configuration of precisely predetermined shape which cooperates with the characteristics of the metal materials embodied in the member so that the member moves to an inverted or oppositely dished shaped configuration with snap action on the occurrence of the member reaching a selected actuating temperature. The member is then movable to return to its original dished shaped configuration on the occurrence of the member reaching a second de-actuation, or differential, temperature to reset the member. Usually there is a substantial difference between the actuating temperature and the reset temperature in order to provide hysteresis and avoid unnecessary cycling of the member.

Such thermally responsive dished shaped metal control members are formed into the precisely predetermined configurations in well known ways and are typically formed of iron alloys to provide strength where the elements are intended to operate at elevated temperatures. One known material system is the use of an iron alloy referred to herein as Alloy 10 as a low expansion layer bonded to another iron alloy referred to herein as Alloy B as a high expansion layer which can provide relatively stable snap acting disc members at low actuation temperatures. However, when the disc members are formed so that the actuating temperature is increased the disc members become unstable above some threshold level dependent upon the geometry of the member and the sigma distribution increases so that the disc members start to fall out of a tolerance range for a given application. Such known disc members having a moderately high actuation temperature, e.g., 130°–150° C., frequently are unstable undergoing significant variations or changes in thermal response characteristics during snap action movement and thermal cycling of the members so that even if they originally met desired performance specifications, over time many drift out of the tolerance range. For example, for certain geometries for some members having an actuating temperature as low as approximately 130° C. the temperature response of the members upon snapping are immediately found to display as much as 1° to 5° C. decrease in actuating temperature response characteristics and undergo additional drift in response characteristics of similar or greater magnitude over a typical service life. For any given geometry, the above problems are exacerbated as the actuation temperature is increased.

It is an object of the present invention to provide thermostatic snap acting disc members which have a high actuation temperature, for example, on the order of 150° C. and higher. Another object is the provision of such high temperature thermostatic snap acting discs which are stable having a selected actuating temperature which essentially does not change over time and which have a low sigma distribution relative to the tolerance range of a given application. Yet another object is the provision of high actuating temperature thermostatic, snap acting discs, for example, in the order of 150° C. or higher, which have a wide differential de-actuating temperature of up to 200° C. or more below the actuation temperature making them useful as non-resettable control members. Still another object of the invention is the provision of temperature responsive switches employing such high temperature snap acting thermostatic discs.

BRIEF SUMMARY OF THE INVENTION

Briefly, in accordance with the invention, a snap acting disc member comprises a first layer of metal of relatively high coefficient of thermal expansion metallurgically bonded to a second layer of metal having a relatively low coefficient of thermal expansion with each of the layers having similar moduli of elasticity. According to a feature of the invention, the disc member is formed with a dished shaped configuration to provide a selected, relatively high, actuating temperature. According to another feature of the invention, the metal serving as the low expansion layer is a hardenable stainless steel which is strengthened after being formed into the dished shaped configuration. According to another feature of the invention, the strengthened disc member may be formed having a wide differential between the actuation temperature at which it snaps from its first, at rest, dished shaped configuration, to its second, oppositely actuated dished shaped configuration and a lower de-actuation temperature at which it snaps from its second actuated dished shaped configuration back to its first at rest dished shaped configuration with the differential temperature being in the range of 200° C. or more below the actuation temperature. According to a feature of the invention, the first layer comprises a high carbon alloy having a modulus of elasticity of approximately $26–27\times10^6$ psi and the second layer comprising a hardenable stainless steel having a modulus of elasticity of approximately $26–29\times10^6$ psi. According to yet another feature of the invention, a third layer of metal may be interposed between and metallurgically bonded to the first and second outer layers in order to adjust the electrical resistivity of the member for use as an electrical current carrying member in an electrical switch. According to another feature of the invention, high temperature thermostatic disc members made in accordance with the invention are employed in electrical switches either as a current carrying member or solely as a heat sensing member.

Various other objects and advantages will appear from the following description of several embodiments of the invention and the novel features will be particularly pointed out hereinafter in connection with the accompanying drawings and the appended claims.

DETAILED DESCRIPTION OF THE PREFERRED EMBODIMENTS

Figure 1:
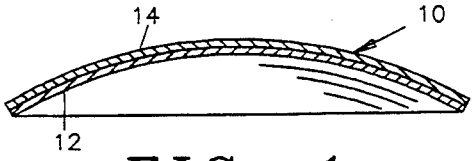
FIG. 1 is a cross-sectional view taken through a thermostatic disc member made in accordance with the invention.

With reference to FIG. 1 a high temperature thermostatic disc member 10 made in accordance with the invention comprises a first layer 12 of metal having a relatively high coefficient of thermal expansion metallurgically bonded to a second layer 14 of metal having a relatively low coefficient of thermal expansion. Both layers 12 and 14 are selected to have similar moduli of elasticity, that is, within approximately $+/-1.5\times10^6$ psi. In order to provide a disc being responsive to a high temperature, for example, 150° C. or higher, layer 12 comprises a high carbon alloy such as Alloy B, high carbon Alloy B or Alloy C, each having a modulus of elasticity of approximately $26\text{–}27\times10^6$ psi. Alloy B, has a nominal composition by weight percent of from 0.12 to 0.15 carbon, 21.3 to 22.5 nickel, 3 to 3.3 chromium and the balance iron. High carbon alloy B has a nominal composition by weight percent of from 0.22 to 0.24 carbon, 21.3 to 22.5 nickel, 3 to 3.3 chromium and the balance iron. Alloy C has a nominal composition of 0.50 to 0.61 carbon, 19.1 to 20.7 nickel, 2 to 2.5 chromium and the balance iron.

Second layer 14 is selected from hardenable stainless steels, for example, a precipitation hardenable stainless steel, having a modulus of elasticity of approximately $26\text{–}29\times10^6$ psi and, in the annealed condition suitable for being able to be formed into a dished shaped configuration and then heat treated to increase its strength to a level preferably higher than that of first layer 12 to thereby strengthen and stabilize the disc member. Suitable stainless steels include PH 13-8 MO, S17400, S17700, S15700, S35000, S35500, S15500, S45000 and S45500.

PH 13-8 MO is a registered trademark of Armco Steel Corporation for stainless steel having a nominal composition by weight as follows:

| | | | |
|---|---|---|---|
| Carbon | 0.07 max. | Chromium | 12.25–13.25 |
| Manganese | 0.1 max. | Nickel | 7.5–8.5 |
| Phosphorous | 0.01 max. | Aluminum | 0.9–1.35 |
| Sulfur | 0.008 max. | Molybdenum | 2.0–2.5 |
| Silicon | 0.1 max. | Nitrogen | 0.01 max. |
| | | Balance | Iron |

Stainless steels having an S designation followed by 5 numerals is a designation of American Society for Metals and AISI is a designation of American Iron and Steel Institute.

S17400 (AISI type 630) stainless steel has a nominal composition of weight % as follows:

| | | | |
|---|---|---|---|
| Carbon | 0.07 max. | Chromium | 15.55–17.5 |
| Manganese | 1.00 max. | Nickel | 3–5 |
| Phosphorous | 0.040 max. | Copper | 3–5 |
| Sulfur | 0.030 max. | Niobium and Tantalum | 0.15–0.45 |
| Silicon | 1.00 max. | Balance | Iron |

S17700 (AISI type 631) stainless steel has a nominal composition by weight % as follows:

| | | | |
|---|---|---|---|
| Carbon | 0.09 max. | Chromium | 16–18 |
| Manganese | 1.00 max. | Nickel | 6.60–7.75 |
| Phosphorous | 0.040 max. | Aluminum | 0.75–1.50 |
| Sulfur | 0.040 max. | Balance | Iron |
| Silicon | 0.40 max. | | |

S15700 (AISI type 632) stainless steel has a nominal composition by weight % as follows:

| | | | |
|---|---|---|---|
| Carbon | 0.09 max. | Chromium | 14–16 |
| Manganese | 1.00 max. | Nickel | 6.50–7.75 |
| Phosphorous | 0.04 max. | Molybdenum | 2–3 |
| Sulfur | 0.03 max. | Aluminum | 0.75–1.50 |
| Silicon | 1.00 max. | Balance | Iron |

S35000 (AISI type 633) stainless steel has a nominal composition by weight % as follows:

| | | | |
|---|---|---|---|
| Carbon | 0.07–0.11 | Chromium | 16–17 |
| Manganese | 0.50–1.25 | Nickel | 4–5 |
| Phosphorous | 0.04 max. | Molybdenum | 2.50–3.25 |
| Sulfur | 0.03 max. | Nitrogen | 0.07–0.13 |
| Silicon | 0.50 max. | Balance | Iron |

S35500 (AISI type 634) stainless steel has a nominal composition by weight % as follows:

| | | | |
|---|---|---|---|
| Carbon | 0.10–0.15 | Chromium | 15–16 |
| Manganese | 0.50–1.25 | Nickel | 4–5 |
| Phosphorous | 0.04 max. | Molybdenum | 2.50–3.25 |
| Sulfur | 0.030 max. | Nitrogen | 0.07–0.13 |
| Silicon | 0.50 max. | Balance | Iron |

S15500 (AISI type 15500) stainless steel has a nominal composition by weight % as follows:

| | | | |
|---|---|---|---|
| Carbon | 0.07 max. | Chromium | 14–15.5 |
| Manganese | 1.00 max. | Nickel | 3.5–5.5 |
| Phosphorous | 0.040 max. | Copper | 2.5–4.5 |
| Sulfur | 0.030 max. | Niobium and Tantalum | 0.15–0.45 |
| Silicon | 1.00 max. | Balance | Iron |

S45000 stainless steel has a nominal composition by weight % as follows:

| | | | |
|---|---|---|---|
| Carbon | 0.05 max. | Chromium | 14.00–16.00 |
| Manganese | 1.00 max. | Nickel | 5.00–7.00 |
| Phosphorous | 0.03 max. | Molybdenum | 0.50–1.00 |
| Sulfur | 0.03 max. | Copper | 1.25–1.75 |
| Silicon | 1.00 max. | Niobium | Minimum content is eight times carbon content |

S45500 stainless steel has a nominal composition by weight % as follows:

| | | | |
|---|---|---|---|
| Carbon | 0.05 max. | Chromium | 7.50–9.50 |
| Manganese | 0.50 max. | Titanium | 0.80–1.40 |
| Phosphorous | 0.040 max. | Columbium and Tantalum | 0.10–0.50 |
| Sulfur | 0.030 max. | Copper | 1.50–2.50 |
| Silicon | 0.50 max. | Molybdenum | 0.50 max. |
| Chromium | 11.00–12.50 | Balance | Iron |

S45500 stainless steel having both high modulus and high strength characteristics is particularly effective for use as layer 14. S45500 stainless steel is a martensitic age-hardenable stainless steel which is relatively soft and formable in the annealed condition. Layers 12 and 14 are metallurgically bonded together, for example, by using conventional roll bonding techniques. The bonded layers are then cut into disc configurations and formed into a dish-shape using conventional snap acting disc forming techniques. The members are then heat treated after being formed to increase the strength of the members. The crown height of the dish-shape, i.e., the distance the center of the dish-shape is deformed in a vertical direction relative to the outer periphery of the member, is selected to provide a selected temperature at which the disc member will actuate or snap from the first dished configuration to a second, oppositely dished configuration. Advantageously the member has relatively low flexivity so that the amount of deformation required for high actuation temperatures is relatively little so that the disc member assumes a low profile and can be mounted in an electric switch occupying a minimal amount of vertical space.

High temperature, snap acting thermostatic disc members made in accordance with the invention have greater stability and fatigue strength compared to prior art disc members as well as having higher actuation temperature capability. As mentioned above, conventional disc members used for relatively low actuation temperatures employ Alloy 10 materials or the like as the low expansion or inactive layer along with Alloy B or the like as the high expansion or active layer. Alloy 10 type materials, having a nominal composition by weight percent of 35.5 to 52.0 nickel and the balance iron, have a modulus of elasticity of approximately 20–24 $10^6$ psi, significantly different from that of the Alloy B type materials.

In accordance with the invention, both the low and high expansion sides are selected having similar moduli of elasticity. When combined with a high expansion side layer of Alloy B, high carbon Alloy B or Alloy C by conventional roll bonding techniques the composite member will retain a sufficient residual differential expansion to function as a bi-stable temperature responsive dished shaped metal control member. The higher modulus of the inactive element results in a thermal force capability increase of about 40% over that available in existing Alloy 10 type elements. The low expansion element is also selected so that its strength is higher than that of the active or high expansion layer. The inactive layer no longer serves as the limiting element for the composite metal strength as in conventional systems but rather serves to substantially increase composite member thermal force and differential temperature capability of the member. Stability is markedly enhanced through the selection of material having such similar moduli.

Figure 4:
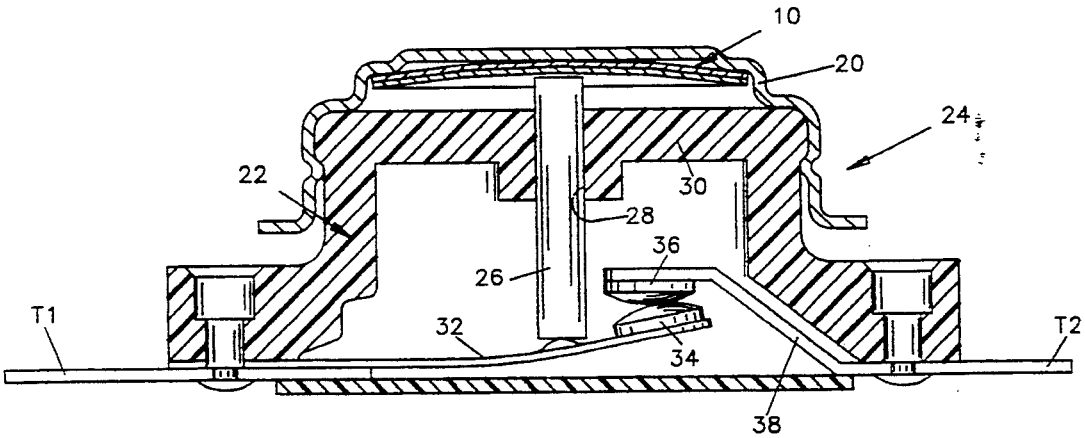
FIG. 4 is a cross-sectional view of an electric switch in which a thermostatic disc member made in accordance with the invention is employed solely as a heat sensing member.

Snap acting disc member 10 made in accordance with the invention can be used in applications where the disc member is employed as a heat sensor, for example, as shown in FIG. 4 wherein disc member 10 is disposed in a heat sensing cup 20 formed of suitable heat conductive material which in turn is attached to the housing 22 of a thermostatic type electrical switch 24. A motion transfer pin 26 is slidably disposed in a bore 28 formed in the end wall 30 and extends between disc member 10 and a movable contact arm 32. An electrical contact 34 is mounted on movable contact arm 32 and is adapted to move into and out of electrical engagement with a stationary electrical contact 36 disposed on a stationary contact arm 38. Movable contact 34 is shown normally biased into engagement with stationary contact 36; however, it will be understood that stationary contact 36 could be disposed on the other side of movable contact arm if reverse open/close contact logic is desired. Movable contact arm 32 is electrically connected to a first terminal T1 and stationary contact arm 38 serves as a second terminal T2. Snap acting disc member is shown in its first dished configuration with movable contact 34 in electrical engagement with stationary contact 36. When the temperature of disc member is raised to its actuation temperature the disc member will snap to its second, opposite dished configuration forcing motion transfer pin to move downwardly, as seen in FIG. 4, to separate the contacts and open the switch. The switch is then maintained in the open condition until the temperature of disc member 10 is lowered to its de-actuation temperature which is chosen to be a selected level below the actuation temperature, from approximately 5° C. to 200° C.

Figure 3:
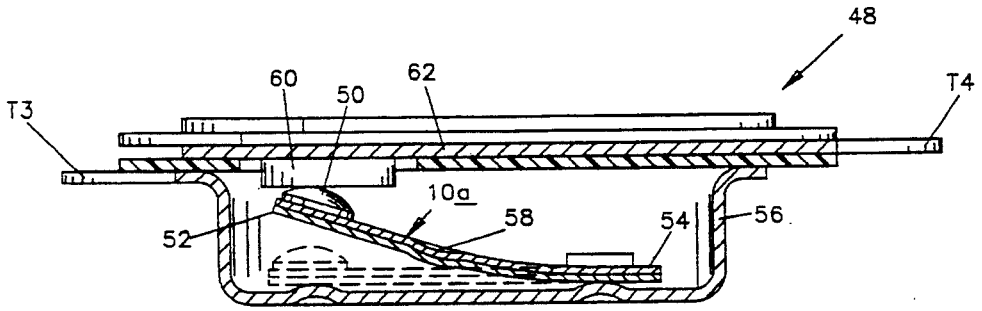
FIG. 3 is a cross-sectional view of an electric switch in which a thermostatic disc member made in accordance with the invention is employed as a current carrying member.

High temperature disc members made in accordance with the invention can also be used as a current carrying member as shown in switch 48 of FIG. 3 in which a snap acting disc member **10*a*, formed of material made in accordance with the invention such as member 10 of FIG. 1, has a movable electrical contact 50 mounted at one distal end 52 as by welding thereto, while its opposite distal end 54 is mounted to electrically conductive wall member 56, as by welding thereto. Disc member 10*a* may be formed as a strip of material having a dished portion 58 formed therein intermediate distal ends 52, 54 causing it to snap from a first dished configuration shown in solid lines in FIG. 3 with movable contact 50 in electrical engagement with a stationary contact 60 mounted on an electrically conductive lid 62 attached to but electrically insulated from wall member 56. Wall member 56 may be integrally connected to a terminal T3 while lid 62 can be formed with a terminal T4. The disc snaps to a second, oppositely dished configuration shown in dashed lines, when the temperature of disc member 10*a*** reaches its actuation temperature due to heat generated by current passing through the disc member and/or heat thermally conducted to the disc member from its environment.

Figure 2:
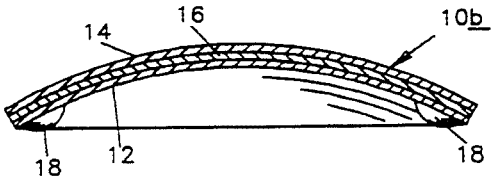
FIG. 2 is a cross-sectional view similar to FIG. 1 of a thermostatic disc member made in accordance with a second embodiment of the invention.

Disc members formed in accordance with the invention have an electrical resistivity in the range of approximately 30–750 ohms/circular milfoot (cmf). For example, disc member 10 made of Alloy B and S45500 stainless steel has an electrical resistivity of approximately 450 ohms/cmf. In some applications, when the disc member is used as a current carrying member it may be desirable to have a different resistivity range. This can be provided by interposing a layer 16 of metal having a selected resistivity, for example, copper if it is desired to have a lower resistivity, nickel if it is desired to have an intermediate resistivity or manganese, copper, nickel alloy for a higher resistivity. As seen in FIG. 2 a high temperature, thermostatic disc member **10*b* is formed of outer layers 12 and 14 having similar moduli of elasticity. As shown in FIG. 2 embodiment, an intermediate layer 16 serves to modify the resistivity. The FIG. 2 disc can be used with suitable electrical contacts 18 as a current carrying member or, without electrical contacts, as a heat sensing member as in the FIG. 4** switch.

Thus, in accordance with the invention, a hardenable stainless steel having a certain coefficient of thermal expansion is metallurgically bonded to an alloy having a relatively higher coefficient of thermal expansion and having similar moduli of elasticity. The composite member is formed into a dished configuration to actuate at a selected temperature above approximately 150° C. and then heat treated to further its strength.

Snap acting discs made in accordance with the invention can be used in high temperature environments, for example, in high efficiency compressor applications where the normal operational environment is in the order of 170° C. and where an actuating temperature of 180° C. or higher is desired. That is, the disc member is used to sense the temperature within a compressor and to de-energize the protector in the event that the temperature, due to some malfunction, exceeds a selected safe limit. Another useful high temperature application uses a disc member having a wide differential between actuation and de-actuation temperatures. For example, in a coffee pot application where a disc member is used as a non-resettable protector having an actuation temperature of approximately 180° C. and a reset temperature of −40° C. so that, in practice, once the disc snaps at the actuation temperature due to a malfunction of the coffee pot or the like it will remain in its actuated condition.

As various changes could be made in the above construction without departing from the scope of the invention, it is intended that all matter included in the above description or shown in the accompanied drawings be interpreted as illustrative and not in a limiting sense and that the invention includes all modifications and equivalents of the described embodiments of the invention falling within the scope of the appended claims.

We claim:

1. A temperature-responsive dished shaped metal control member comprising a plurality of metal layers metallurgically bonded together including a first outer layer of metal of relatively high coefficient of thermal expansion and a second outer layer of metal of relatively low coefficient of thermal expansion of a precipitation hardenable stainless steel for forming a composite thermostat metal in which the first and second layers have similar moduli of elasticity, the composite thermostat metal having a dished configuration formed therein to provide the member with snap acting characteristics whereby the member will move to an oppositely dished configuration at a selected actuating temperature.

2. A temperature-responsive dished metal control member according to claim 1 in which the member has a first dished configuration at temperatures up to the actuation temperature at which it snaps to an opposite dished configuration which is maintained until the member reaches a differential temperature in the range of 200° C. or more below the actuation temperature at which the member snaps back to its first dished configuration.

3. A temperature-responsive dished metal control member according to claim 1 in which the first layer comprises an alloy having from 0.12 to 0.61% by weight carbon.

4. A temperature-responsive dished metal control member according to claim 1 in which the second layer is selected from the group consisting of PH 13-8 MO, S17400, S17700, S15700, S35000, S35500, S15500, S45000 and S45500.

5. A temperature-responsive dished metal control member according to claim 1 in which the second layer comprises type S45500 stainless steel.

6. A high temperature, temperature-responsive dished metal control member according to claim 1 in which the modulus of elasticity of each layer is approximately $26–29\times10^6$ psi.

7. A high temperature, temperature-responsive dished metal control member according to claim 1 including a third metal layer disposed intermediate and metallurgically bonded to the first and second layers to adjust the electrical resistivity of the member.

8. An electric switch having first and second terminals and a temperature-responsive dished shaped metal control member having a plurality of metal layers metallurgically bonded together including a first outer layer of metal of relatively high coefficient of thermal expansion and a second outer layer of metal having a relatively low coefficient of thermal expansion of a precipitation hardenable stainless steel, both first and second layers having similar moduli of elasticity, the dished shaped metal control member being movable from a first dished shaped configuration to a second, oppositely dished shaped configuration upon reaching a selected actuation temperature, the switch mounting a movable and a stationary electrical contact, the movable electrical contact movable between a position of engagement with the stationary contact and a position of disengagement with the stationary contact, the dished shaped metal control member coupled to the movable contact to move the movable contact into one of its engagement and disengagement positions upon moving the control member from its first dished shaped configuration to its second dished shaped configuration.

9. An electrical switch according to claim 8 in which the metal control member moves from its second dished shaped configuration back to its first dished shaped configuration when the temperature of the control member decreases to a de-actuation temperature in the range of 5° C. to over 200° C. below the actuation temperature.

10. A method for forming a temperature-responsive dished shaped metal control member comprising the steps of:

taking a first layer of alloy having a carbon content of from 0.12 to 0.61 by weight % of carbon and a modulus of elasticity, taking a second layer of a precipitation hardenable stainless steel having a modulus of elasticity similar to that of the first layer, metallurgically bonding the first and second layers together to form a composite member, plastically deforming at least a portion of the member to produce a dished member, and heat treating the dished member to increase its strength.

11. A method according to claim 10 in which the modulus of elasticity of each layer is approximately $26–29\times10^6$ psi.

12. A method according to claim 10 in which the second layer is selected from the group consisting of PH 13-8 MO, S17400, S17700, S15700, S35000, S35500, S15500, S45000 and S45500.

13. A method according to claim 10 in which the second layer is S45500.

14. A method according to claim 10 in which the second layer is S17400.

15. A method according to claim 10 in which the second layer is S17700.

16. A method according to claim 10 in which the second layer is S45000.

17. A temperature-responsive dished shaped metal control member according to claim 1 in which the moduli of elasticity of the first and second layers are within approximately $+/-1.5\times10^6$ psi.

18. A method according to claim 10 in which the moduli of elasticity of the first and second layers are within approximately $+/-1.5\times10^6$ psi.

* * * * *